US007684581B2

(12) United States Patent
Wagner et al.

(10) Patent No.: US 7,684,581 B2
(45) Date of Patent: Mar. 23, 2010

(54) BEHIND THE EAR HEARING DEVICE HOUSING WITH SELF-ADHERING PROPERTIES

(75) Inventors: Josef Wagner, Richterswil (CH); Ora Bürkli-Halevy, Stafa (CH)

(73) Assignee: Phonak AG, Stafa (CH)

( * ) Notice: Subject to any disclaimer, the term of this patent is extended or adjusted under 35 U.S.C. 154(b) by 1176 days.

(21) Appl. No.: 11/265,038

(22) Filed: Nov. 2, 2005

(65) Prior Publication Data

US 2007/0047752 A1 Mar. 1, 2007

Related U.S. Application Data

(63) Continuation-in-part of application No. 11/210,423, filed on Aug. 24, 2005.

(51) Int. Cl.
*H04R 25/00* (2006.01)

(52) U.S. Cl. ..... 381/330; 381/322; 381/381

(58) Field of Classification Search ..... 381/322, 381/324, 328, 330, 380, 381; 181/129, 130, 181/135

See application file for complete search history.

(56) References Cited

U.S. PATENT DOCUMENTS 4,869,339 A * 9/1989 Barton ..... 181/130
5,654,530 A * 8/1997 Sauer et al. ..... 181/130
6,167,141 A * 12/2000 Yoest ..... 381/322

* cited by examiner

*Primary Examiner*—Huyen D Le
(74) *Attorney, Agent, or Firm*—Pearne & Gordon LLP

(57) ABSTRACT

A micro electrical and/or electronical device, as in particular a hearing aid being worn e.g. behind the ear, is characterized by a housing shell (1), which at least partially comprises a skid-proof surface (11). This skid-proof surface can be made out of an elastomeric polymer or an elastic polymer. Preferably such part (11) of the surface of the housing or shell (1) is being made skid-proof, which is in contact with the skin, while wearing the hearing aid.

12 Claims, 2 Drawing Sheets

BEHIND THE EAR HEARING DEVICE HOUSING WITH SELF-ADHERING PROPERTIES

Figure 1:
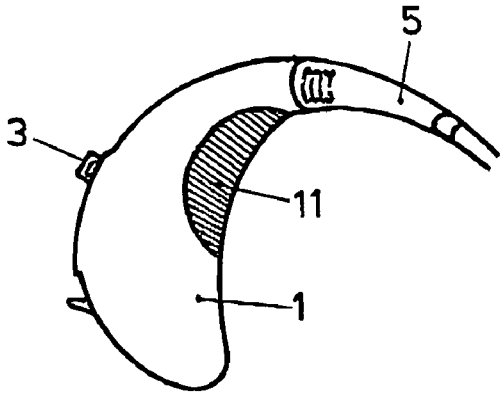

The present invention refers to small electronic devices such as hearing device as well as to a process for the production of the hearing device, a device for the position firm arrangement of a hearing device as well as a process for the self adhering shaping of the surface of hearing device housings.

Hearing devices as in particular behind the ear hearing devices are getting smaller and smaller and the hook, which keeps the hearing device in position behind the ear, is becoming smaller and smaller and even thinner. In addition also designs are possible having no hook at all at the ear if the acoustic conduit is directed over another path into the ear cannel.

On one hand these are desirable properties for a user of a hearing device, but on the other hand there exists the problem, that those hearing devices will not remain in position anymore, which means in other words, may fall cut of their position. In particular at sports activities or at physical work this problem is especially serious, as usually the head is strongly moved and therefore used hearing devices will not remain in position. A further problem is keeping hearing devices in place at small children or new born children which do have small ears and a tissue which is too soft to keep a hearing device in place.

One solution of the problem consists in the use of clamp like positioning aids to keep the hearing device behind the ear in position, which is not very user friendly.

Therefore it is an object of the present invention to propose measures, so that also smaller electronic devices such as hearing devices as in particular hearing devices with a small hook can be kept safely in position behind the ear.

According to the present invention the object is solved in particular by means of a smallest electronic device such as a hearing device.

Therefore it is proposed e.g., that the hearing aid housing comprises at least partially a skid-proof surface or means or a device coated on or being attached on or at the housing which enables position firm or self adhering arrangement of the hearing aid housing. This skid-proof surface or skid-proof shaped surface is arranged preferably in an area of the hearing aid housing, which is in contact to the user person. This skid-proof designed or self adhering shaped surface may consist e.g. of an elastomeric polymer or may comprise means such as e.g. a hydrogel which besides hydrophilic properties may eventually also comprise self-adhering properties.

The skid-proof surface may also include the characteristic to slightly suck on the skin in case of humidity or perspiration respectively. This effect leads to an improved hold and as a consequence to an improved comfort for the user in situations, where conventionally known hearing devices start slipping. The elastomeric polymer can be e.g. a natural rubber, a synthetic rubber as in particular a rubber on isoprene basis, a silicon rubber, an elastomeric polymer on the basis of styrene, butadiene and isoprene, etc. Of course also thermoplastic elastomeres may be used for this application such as e.g. styrene blockcopolymers ore polyurethane elastomeres in particular in combination with multi component injection moulding.

According to a further embodiment it is also possible, that the elastomeric material is shaped slightly open porouse, to improve the adherence properties. This open porosity can e.g. also be achieved by at least partially foaming the elastomeric material.

In particular in medical technique e.g. so called adhering silicon materials are known, comprising an especially good skin and body compatibility. In addition such adhering silicon materials do also have self-adhering properties on the skin, which in connection with the present invention is advantageous. Also known in medical technique a further class of materials is known, with the aid of such materials an inventive housing of a hearing device can be implemented or in other words a hearing aid housing can be placed position firm as proposed according the present invention. Those materials are hydrogels, which are already known for along time in medical technique e.g. for placing self-adhering electrocardiogram (ECG) pads on the human body. By means of such kind of hydrogels the electrodes at ECG measuring can be bonded on the skin during several hours until to several days.

Hydrogels are partially interlaced plastic formable and hydrophilic polymers or copolymers respectively which include further surface wetting or surface moistening additives and which have the ability to collect water or to bind water but without being soluble within water. Due to the very good wetting properties hydrogels do have very good self-adhering properties and therefore are suitable e.g. being coated on a hearing aid device to place it position firm e.g. behind the ear.

For treating the housing surface e.g. of a hearing aid of course also other at least partially elastomeric polymers can be used, which are medically harmless and which do have a good skin compatibility and comprise self-adhering properties.

In addition it is possible to use skid-proof parts in various colours. As a consequence the skid-proof parts can be distinguished by different colours or can be kept in the same colour as the housing of the hearing aid.

According to a further embodiment it is possible to produce part of the hearing aid housing by using the proposed elastomeric material e.g. by means of a so called 2K injection moulding process. Of course it is also possible to use the proposed elastomeric material for the production of the whole housing.

According again to a further embodiment, it is also possible to place a coating on an already existing, commonly used, hearing aid housing or a hearing aid shell, either by means of a coating technique or by means of bonding of so called a double sided adhering pads. Those adhering pads may be either firmly placed onto the hearing aid housing or shell or again removable, which does have the advantage that after a certain wearing time, those adhering pads may be replaced. Such kind of adhering pads can be made out of the above mentioned hydrogels or may comprise hydrogels. But also known adhesives such as acrylates can be used as known from double sided adhering tapes. It is also possible to produce parts of the hearing aid housing or shell as adhering chips, which can be attached replaceable onto or within the housing.

Again, according to a further embodiment, it is possible to achieve the adherence improving surface by means of an encaseable elastic stocking like tube, which can be covered over a conventional hearing aid housing. By producing respective holes within the elastic tube, existing control elements arranged on the housing still can be operated. By using a stocking like elastic tubing, it is possible to arrange respective guides, groovings or knobs respectively already at or on the hearing aid housing, so that the tube can be arranged securely in position at the hearing aid.

As already mentioned it is possible to directly produce the inventively proposed hearing aid e.g. by moulding simultaneously two materials at the production of the housing, whereby at least one of the materials should be the inventively proposed, at least partially elastomeric polymer. It understands itself automatically, that at least such parts of the surface have to be provided with this material, which at wearing of the hearing aid is in contact with the skin or the part of the body behind the ear.

Another production method is that first at the production of the hearing aid housing recessed or deepened parts are arranged in the sense of a preprint in which afterwards the self-adhering pads made out of the elastomeric material can be placed or bonded.

The great advantage of the inventively proposed position firm or skid-proof hearing aids is that they can also be used by active people in all kinds of circumstances without any problems, what certainly can also strengthen the personality of the user. At the today used hearing aids and in particular such, which do have very small housings and very small hooks, it is a disadvantage that those devices have to be taken off by people being active. The present invention is of course not only limited to hearing aids, but can also be applied to other smallest devices or micro devices as e.g. headsets, communication devices, etc. which may be worn in the area of the ear and which due to the smallest dimensioning can not be kept in position anymore.

Figure 2:
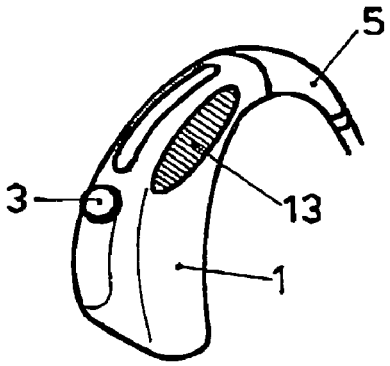
Figure 3:
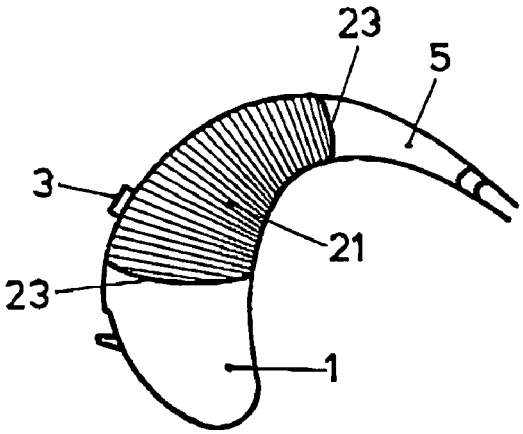
Figure 4:
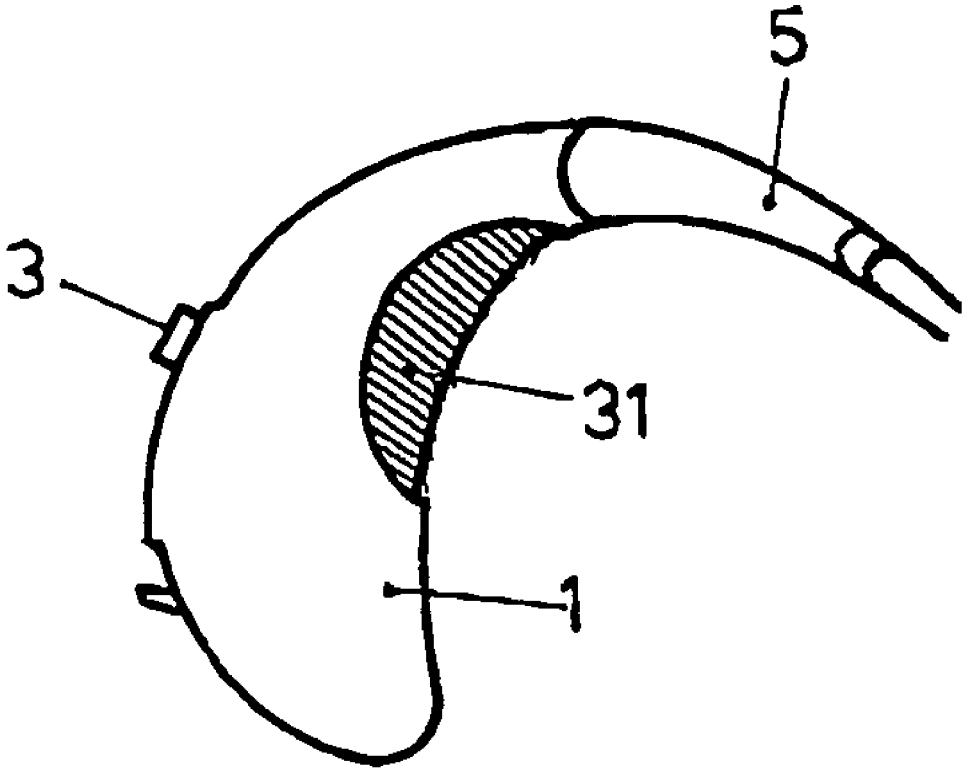

The invention shall be described in more details, based on examples and with reference to the attached drawings, in which, FIG. 1 shows schematically and seen from the side an inventive hearing aid, FIG. 2 shows schematically and in perspective view a further embodiment of the inventive hearing aid, FIG. 3 shows again schematically, seen from the side a hearing aid, comprising a covering elastic stocking like tubing, and FIG. 4 shows schematically and seen from the side a hearing aid housing, comprising a slightly recessed area, provided for attaching a skid-proof surface.

FIG. 1 shows schematically and seen from the side a hearing aid 1 comprising e.g. a controlling element 3, as well as a so called hook 5, arranged at the hearing aid for connecting the hearing aid via a connecting tube to the oto-plastic. On the surface, which is provided to rest on the skin behind the ear, a skid-proof part 11 is shaped, consisting e.g. out of a hydrophilic elastomeric polymer such as e.g. synthetic rubber, silicon rubber, styrene butadiene styrene elastomer, or of other thermoplastic elastomer. This part 11 can e.g. be produced already at the production of the hearing aid housing by means of so called 2K moulding technique, as the two polymers used for the hearing aid housing production are injected simultaneously into a mould.

FIG. 2 shows in perspective view, seen from the front side, a further embodiment of the inventive hearing aid 1, including a microphone cover, at which the skid-proof shaped surface part 13 is produced by bonding respective self-adhering pads. Those pads can be firmly bonded onto the housing as well as again removable, which has the advantage, that after a certain wearing time, those pads can be replaced. As hearing aids usually are quite expensive, it certainly makes sense, if such kinds of pads, which while wearing on the skin, can be contaminated by perspiration, can be replaced or cleaned from time to time. In particular using self-adhering hydrogel pads for bonding the hearing aid onto the skin e.g. at small children or babies it is advantageous, it those pads can be changed every day on one side due to sanitary reasons and on the other side also to guarantee a constant and firm placement of the hearing aid.

Instead of adhering pads or a hydrogel pads there also exists the possibility to use a double side adherent adhesives tape or plaster. In particular in medical technique conventionally known double sided adhesives tapes usually comprise acrylate adhesives whereas of course any other physiologically uncritical adhesives can be used, which usually are applied to such kind of adhesive tapes. Such kind of double sided adhesives tapes are in particular suitable for the use at conventional hearing aid devices, on which no surface parts or sections are provided for the attachment of e.g. the above mentioned adhering pads.

Again a further embodiment of the invention is shown in FIG. 3, where a stocking like tube 21 is pulled onto a hearing aid housing 1 for creating the skid-proof surface. To ensure, that this tube 21 is kept position firm on the housing 1 it is preferred that respective guidings or recesses 23 are provided, which e.g. can already be arranged on the housing during the moulding process. Also the tube 21 as proposed in FIG. 3 can be replaced easily. Suitable materials for the production of the inventively proposed skid-proof made tube are preferably hydrophilic elastomeric materials e.g. on the basis of silicon rubber. But also elastomeric co-polyamide materials and the like, can certainly be used for the production of the inventively proposed skid-proof tube. Furthermore it certainly is possible to produce the tube in various colours. As a consequence the skid-proof parts can be distinguished either by different colours or can be made, using the same colours as for the housing of the hearing aid.

Finally FIG. 4 should illustrate how on a conventional hearing aid housing respective parts can be provided, on which the skid-proof shaped and self-adhering polymers can be arranged. Preferably on the hearing aid housing a preprint 31 can be provided, which slightly is deepened or recessed, so that afterwards a self-adhering elastomeric pad, as e.g. consisting out of silicon rubber, or a hydrogel-pad can he inserted.

The hearing aid housings as shown with reference to the FIGS. 1-4 and the mentioned used materials are of course only examples, which are used for the better explanation of the present invention. As a consequence it is of course possible to shape the hearing aid shell skid-proof and eventually self-adhering at any part, whereby of course it certainly is preferred to do it at those parts of the housing which are abutting or resting on or at the skin when wearing the hearing aid. But also the mentioned and proposed materials are only examples and any kind of elastomeric polymer or elastic polymer materials can be used, which on one side are characterized by certain hydrophilic properties, which do have certain self-adhering properties and which of course are skin compatible, which means medically harmless. It is even possible, that those materials are slightly open-pored or even polymers may be used, which are slightly foamed. Finally the present invention is not restricted to hearing aid housings, but can also be applied to any kind of different designed smallest devices or micro devices, as in particular in the area of electronics, which are worn on any parts of the body, as in particular in the area of the ear. It can be e.g. a head set, a communication device, a transmission module, etc., which due to the smallest dimensioning can be kept poorly on the body and therefore there exists the danger of falling off of the device.

The invention claimed is:

1. An electrical hearing and/or listening device worn about a pinna comprising:

a housing (1) which at least partially comprises a skid-proof surface (11, 13, 21) to facilitate maintaining a desired position of the device about the pinna; and wherein the skid-proof surface comprises self-adhering properties for bonding the device on the skin of the pinna.

2. The device of claim 1, wherein the skid-proof surface is made out of a hydrophilic material comprising at least one of an elastomeric polymer or an elastic polymer.

3. The device of claim 2, wherein the hydrophilic material is at least partially porous.

4. The device of claim 1 or 2, wherein at least part (11) of the skid-proof surface of the housing contacts a skin surface when worn by a user.

5. The device of claim 1 or 2, wherein the housing comprises at least a partial elastomeric coating on its outer surface.

6. The device of claim 1 or 2, further comprising removable adhering pads having a skid-proof surface that are removably attached to one or more portions of the housing to facilitate maintaining the desired position of the device about the ear.

7. The device of claim 1 or 2, further comprising an elastomeric tube (21) that is removably pulled on to cover the housing to facilitate maintaining the desired position of the device about the ear.

8. The device of claim 7, further comprising at least one of guidances (33), recesses (31), grooves, or knobs located on the housing to facilitate a secure arrangement of one of adhering pads or the tube on or over the housing.

9. The device of claim 1 or 2, wherein the skid-proof surface of the housing is made from an elastomeric polymer, the elastomeric polymer comprises at least one of synthetic rubber, silicon rubber, styrene-butadiene-styrene elastomer, and styrene-isoprene-styrene elastomer.

10. The device of claim 1, wherein the electrical hearing or listening device comprises a hearing aid, headset, and a headset communication device, all of which are worn about at least one ear.

11. The device of claim 1, wherein the skid-proof surface comprises at least one of a hydrogel or a removable double-sided adherent material that when arranged on the housing, bonds the housing to skin in a desired position about the ear, wherein the hydrogel comprises at least one of skin-wetting properties or adherent properties.

12. A process for making an electrical hearing and/or listening device worn about a pinna comprising:

at least partially forming a housing of the device to yield an at least partially formed housing; and forming at least one of guidances, recesses, snapping mechanism, knobs, or grooves on the at least partially formed housing in order to facilitate receiving and positioning at least one removable adhering pad wherein the removable adhering pad comprises self-adhering properties for bonding the device on the skin of the pinna.

* * * * *

UNITED STATES PATENT AND TRADEMARK OFFICE

CERTIFICATE OF CORRECTION

PATENT NO. : 7,684,581 B2
APPLICATION NO. : 11/265038
DATED : March 23, 2010
INVENTOR(S) : Josef Wagner et al.

It is certified that error appears in the above-identified patent and that said Letters Patent is hereby corrected as shown below:

Column 1, line 21, please replace "cut" with -- out --.

Signed and Sealed this

Seventeenth Day of August, 2010

David J. Kappos

David J. Kappos
*Director of the United States Patent and Trademark Office*